US008291739B2

(12) United States Patent
Aramizu et al.

(10) Patent No.: US 8,291,739 B2
(45) Date of Patent: Oct. 23, 2012

(54) TRIMMING PRESS WORKING APPARATUS

(75) Inventors: Teruo Aramizu, Kanagawa (JP); Tadashi Sasahara, Kanagawa (JP); Hideki Kiriaki, Kanagawa (JP)

(73) Assignee: Oiles Corporation, Tokyo (JP)

( * ) Notice: Subject to any disclaimer, the term of this patent is extended or adjusted under 35 U.S.C. 154(b) by 716 days.

(21) Appl. No.: 12/515,452

(22) PCT Filed: Nov. 19, 2007

(86) PCT No.: PCT/JP2007/001259

§ 371 (c)(1),
(2), (4) Date: Jun. 3, 2009

(87) PCT Pub. No.: WO2008/062556

PCT Pub. Date: May 29, 2008

(65) Prior Publication Data

US 2010/0139355 A1 Jun. 10, 2010

(30) Foreign Application Priority Data

Nov. 24, 2006 (JP) ..... 2006-317190

(51) Int. Cl.
*B21D 28/00* (2006.01)
*B21D 28/14* (2006.01)

(52) U.S. Cl. ..... 72/338; 72/325; 83/656; 83/681

(58) Field of Classification Search ..... 83/39, 76.6, 83/213, 214, 325, 338, 404, 656, 681; 72/325, 72/338

See application file for complete search history.

(56) References Cited

U.S. PATENT DOCUMENTS 6,128,987 A * 10/2000 Nakagawa et al. ..... 83/76.9
7,155,948 B2 * 1/2007 Hellgren ..... 72/63
7,322,222 B2 * 1/2008 Kodaka et al. ..... 72/350

FOREIGN PATENT DOCUMENTS

JP 2004/44732 2/2004

OTHER PUBLICATIONS

International Search Report for PCT/JP2007/001259, mailed Jan. 8, 2008.
Microfilm of the Specification and Drawings annexed to the request of Japanese Utility Model Application No. 132133/1981 (Laid-Open No. 38329/1983), (Mar. 12, 1983).

* cited by examiner

*Primary Examiner* — David B Jones
(74) *Attorney, Agent, or Firm* — Nixon & Vanderhye P.C.

(57) ABSTRACT

A trimming press working apparatus 1 includes a trimming means 6 for cutting a plate material 2 along a trimming line 5 which divides a product portion 3 from a non-product portion 4 in the plate material 2; a scrap cutting means 9 for cutting the non-product portion 4 along scrap severing lines 7 each intersecting the trimming line 5 to make the non-product portion 4 into a plurality of scrap pieces 8; and a pad 10 for pressurizing and restraining the product portion 3 of the plate material 2.

6 Claims, 7 Drawing Sheets

TRIMMING PRESS WORKING APPARATUS

This application is the U.S. national phase of International Application No. PCT/JP2007/001259 filed 19 Nov. 2007, which designated the U.S. and claims priority to Japan Application No. 2006-317190 filed 24 Nov. 2006, the entire contents of each of which are hereby incorporated by reference.

TECHNICAL FIELD

The present invention relates to a trimming press working apparatus with a scrap cutter which is adapted to cut a plate material along a trimming line surrounding a portion for serving as a product portion and to cut a non-product portion other than the product portion of the plate material along a scrap severing line.

BACKGROUND ART

[Patent Document 1] JP-A-2003-88923

[Patent Document 2] JP-A-2003-245734

A hood or a door panel of an automobile or the like is manufactured by cutting a plate material along a predetermined trimming line, and a frame-like non-product portion other than the product which is used as the hood or the door panel is generally severed into a plurality of scrap pieces concurrently with the cutting along the trimming line.

Such trimming press working apparatuses with a scrap cutter have been proposed in such as patent documents 1 and 2. Patent document 1 discloses a technique whereby a bite step in an upper scrap cutter with respect to a lower scrap cutter is partially eliminated on the bottom dead center side, and a scrap of this eliminated portion is cut by forcible pulling. Patent document 2 discloses a technique whereby a cutting-edge receiving space for receiving a trimming cutting edge is provided, and cutting in an entire region of a trim line and cutting along a scrap cut line other than a portion contiguous to the trim line are effected in advance, whereupon tear rupture along the scrap cut line in the portion contiguous to the trim line is carried out.

DISCLOSURE OF THE INVENTION

Problems that the Invention is to Solve

If burrs, chips, and the like are produced in the cutting along the trimming line and the severing along the scrap cut line into scrap pieces, the quality of the hood or the door panel as a product is lowered. Chips, in particular, cause traces of foreign objects, which are called "star marks," on the finished surface of the hood or the door panel, and the occurrence of burrs, chips, and the like can be reduced by and large by the technique described in each of the patent documents 1 and 2.

However, with the technique based on the patent document 1, there is a possibility that the severing into scrap pieces becomes unreliable since a large amount of bite is required, and it relies on tension shear. Also with the technique based on the patent document 2, since the portion corresponding to the cutting-edge receiving space is subjected to tear rupture, there is a possibility that the severing into scrap pieces becomes unreliable in the same way as the technique of the patent document 1. With the technique described in each of the patent documents 1 and 2, since tension shear or tear rupture is carried out the occurrence of chips and the like is unavoidable.

The present invention has been devised in view of the above-described aspects, and its object is to provide a trimming press working apparatus in which burrs are not produced in the product portion, and which is capable of eliminating the occurrence of chips and the like and of reliably effecting the severing of the non-product portion into Scrap pieces.

Means for Solving the Problems

In accordance with the present invention, a trimming press working apparatus comprises: trimming means for cutting a plate material along a trimming line which divides a product portion from a non-product portion in the plate material; and scrap cutting means for cutting the non-product portion along a scrap severing line intersecting the trimming line, the trimming means including one trimming press die means having a cutting blade extending along the trimming line and another trimming press die means for cutting the plate material along the trimming line in cooperation with the cutting blade of the one trimming press die means, the scrap cutting means including one scrap cutting press die having a cutting blade extending along the scrap severing line and another scrap cutting press die having a cutting blade extending along the scrap severing line so as to cut the non-product portion along the scrap severing line in cooperation with the cutting blade of the one scrap cutting press die, the another trimming press die means including main trimming press die means having a cutting blade extending along a remaining trimming line portion excluding a trimming line portion extending on a side of a cutting blade of one scrap cutting press die in a vicinity of an intersecting portion between the trimming line and the scrap severing line, so as to cut the plate material along the remaining trimming line portion in cooperation with the cutting blade of the one trimming press die means, and auxiliary trimming press die means having a movable cutting blade disposed so as to extend along the trimming line portion extending on the side of the cutting blade of the one scrap cutting press die and to be movable relative to the cutting blade of the main trimming press die means, so as to cut the plate material in cooperation with the cutting blade of the one trimming press die means along the trimming line portion extending on the side of the cutting blade of the one scrap cutting press die in the vicinity of the intersecting portion between the trimming line and the scrap severing line, the auxiliary trimming press die means having liquid pressure generating means for imparting to the movable cutting blade a cutting force based on compressible liquid pressure.

According to the trimming press working apparatus in accordance with the invention, it is possible to cut a plate material along a trimming line together with the main trimming press die means by a severing force imparted to the movable cutting blade by the liquid pressure generating means of the auxiliary trimming press die means without subjecting the plate material to tension shear or tear rupture, and it is possible to cut a non-product portion of the plate material along a scrap severing line by the scrap cutting means. As a result, it is possible to eliminate the occurrence of chips and the like, and reliably effect the severing of the non-product portion into scrap pieces.

In the liquid pressure generating means, as examples of the liquid for generating the compressible liquid pressure, it is possible to cite a liquid such water in which a porous substance having a multiplicity of pores is present in mixed form as described in JP-A-2004-44732, JP-A-2005-121092, JP-A-2005-121091, and the like or a liquid constituted by flowable organopolysiloxane. As the flowable organopolysiloxane, it is possible to cite, for example, silicone crude rubber, silicone crude rubber with a filler such as silica compounded therein, and silicone gel which is provided with fluidity by suppressing the degree of cross-linking of liquid silicone rubber. Accordingly, the liquid pressure generating means may be adapted to impart to the cutting blade a cutting force based on the compressible liquid pressure derived from such a liquid.

In a preferred example, the cutting blade of the main trimming press die means and the movable cutting blade of the auxiliary trimming press die means are adapted to simultaneously cut the plate material along the trimming line in cooperation with the cutting blade of the one trimming press die means by simultaneously coming into contact with the plate material. Further, the another scrap cutting press die is adapted to cut the non-product portion along the scrap severing line in cooperation with the one scrap cutting press die after the cutting of the plate material along the trimming line by the cutting blade of the main trimming press die means and the movable cutting blade of the auxiliary trimming press die means in cooperation with the cutting blade of the one trimming press die means. Furthermore, one blade surface of the cutting blade of the one scrap cutting press die is disposed forwardly in a pressing direction with a larger step than a thickness of the plate material with respect to a blade surface of the cutting blade of the one trimming press die means.

The liquid pressure generating means may include a cylinder, a piston disposed in the cylinder, a piston rod having one end coupled to the piston and another end with the movable cutting blade disposed thereon, and a compressible liquid disposed in the cylinder. The movable cutting blade may be disposed by being secured to and supported by the other end of the piston rod; however, to facilitate the replacement or interchange of the movable cutting blade, the movable cutting blade may be detachably. disposed by being coupled to and supported by the other end of the piston rod, or may be disposed merely in-face-to-face relation to the other end of the piston rod without being coupled and secured thereto.

Advantages of the Invention

According to the invention, it is possible to provide a trimming press working apparatus in which burrs are not produced in the product portion, and which is capable of eliminating the occurrence of chips and the like and of reliably effecting the severing of the non-product portion into scrap pieces.

Hereafter, a more detailed description will be given of the mode for carrying out the invention with reference to the preferred embodiment shown in the drawings. It should be noted that the present invention is not limited to such an embodiment.

BEST MODE FOR CARRYING OUT THE INVENTION

Figure 1:
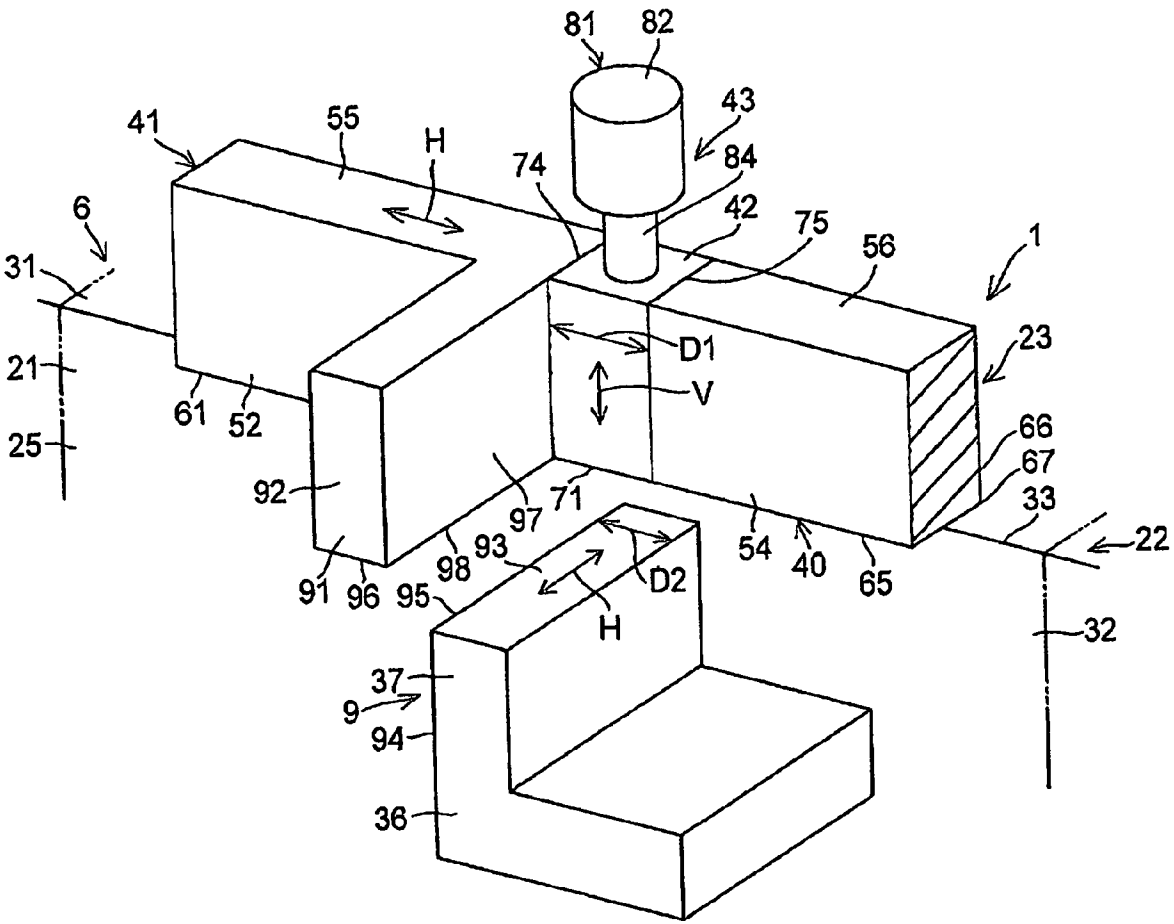
FIG. 1 is a perspective view of a preferred embodiment of the invention.
Figure 2:
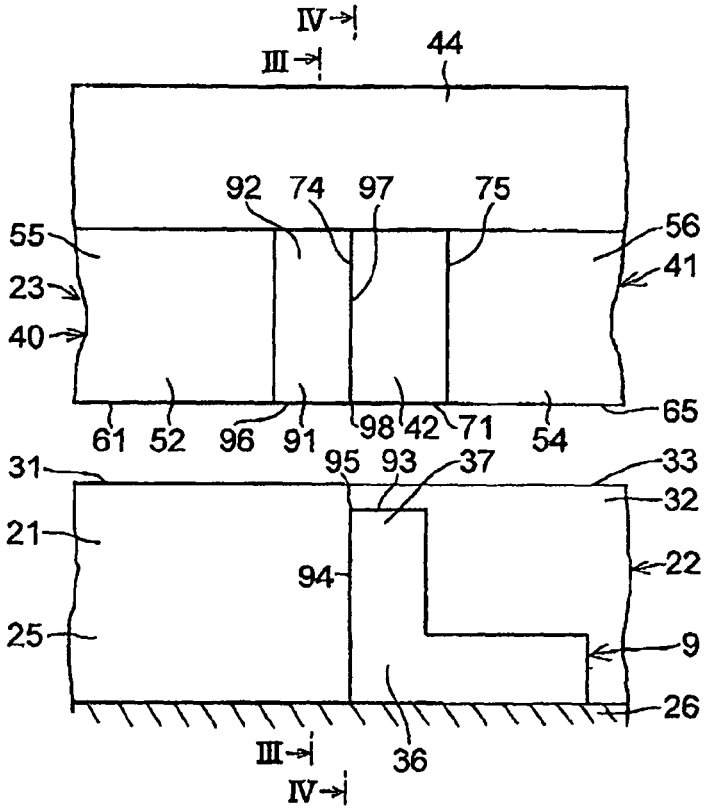
FIG. 2 is a front elevational view of the embodiment shown in FIG. 1.
Figure 3:
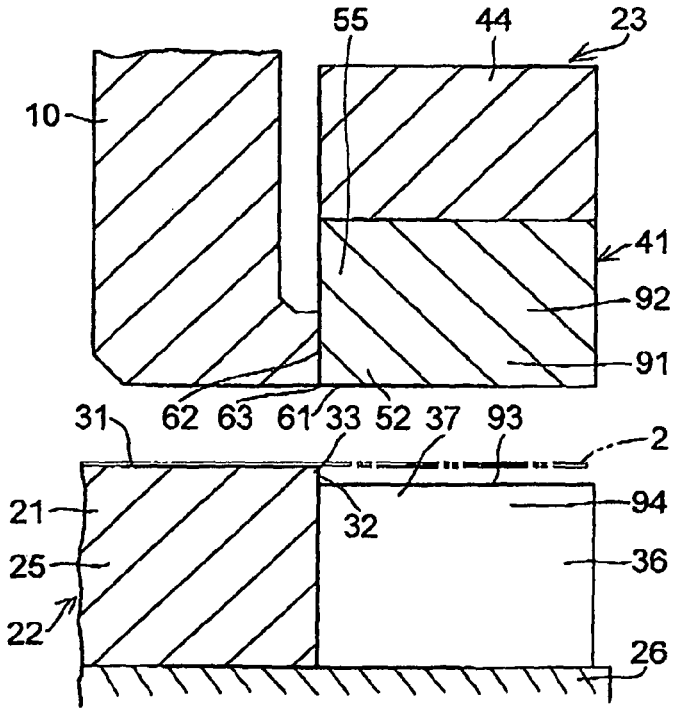
FIG. 3 is a cross-sectional view taken in the direction of arrows along line III-III shown in FIG. 2.
Figure 4:
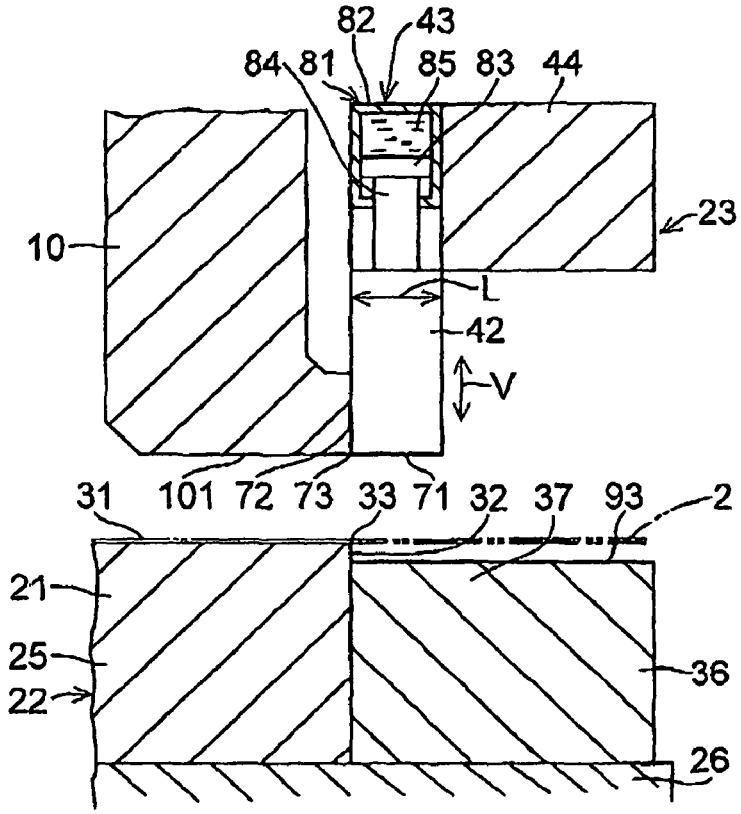
FIG. 4 is a cross-sectional view taken in the direction of arrows along line IV-IV shown in FIG. 2.
Figure 5:
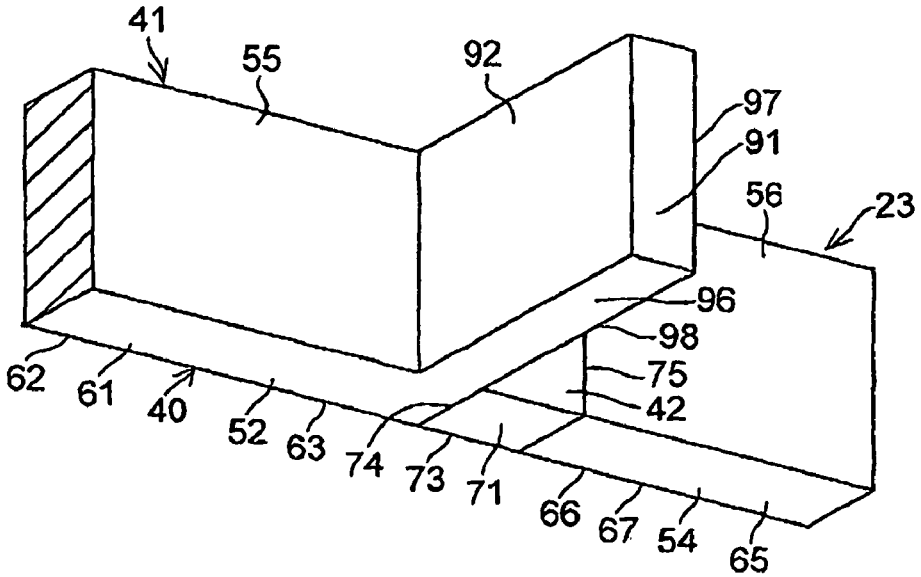
FIG. 5 is a partial perspective view taken from below in the embodiment shown in FIG. 1.
Figure 6:
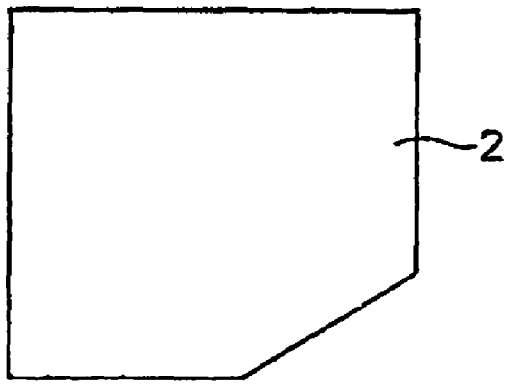
FIG. 6 is a plan view of a plate material which is cut in the embodiment shown in FIG. 1.
Figure 7:
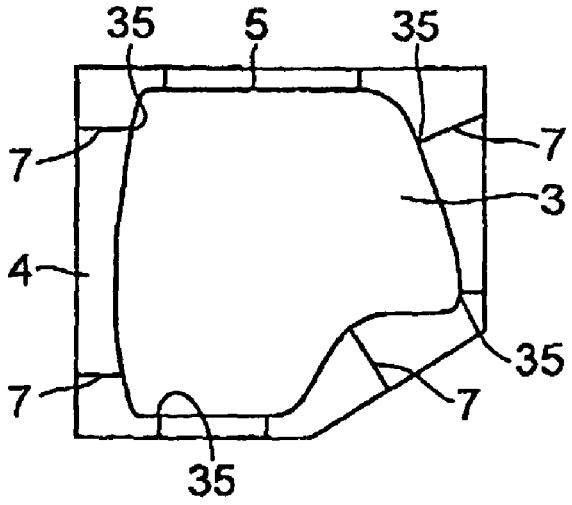
FIG. 7 is a plan view of the plate material, a product portion, and a non-product portion which are cut in the embodiment shown in FIG. 1.
Figure 8:
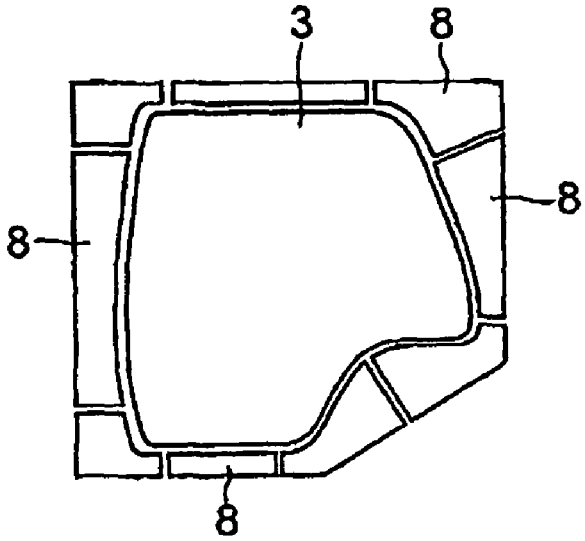
FIG. 8 is a plan view of the plate material, the product portion, the non-product portion, and scrap pieces which have been cut in the embodiment shown in FIG. 1.

In FIGS. 1 to 9, a trimming press working apparatus 1 in accordance with this embodiment includes a trimming means 6 for cutting a plate material 2 along a trimming line 5 which divides a product portion 3 from a non-product portion 4 in the plate material 2; a scrap cutting means 9 for cutting the non-product portion 4 along scrap severing lines 7 each intersecting the trimming line 5 to make the non-product portion 4 into a plurality of scrap pieces 8; and a pad 10 for pressurizing and restraining the product portion 3 of the plate material 2.

The plate material 2 has been subjected to draw forming in a pre-working process to allow the plate material 2 to be formed into a hood, a door panel, or the Like as the product portion 3. With respect to the plate material 2 carried in with such draw forming provided thereto, the trimming press working apparatus 1 is adapted to effect the trimmings for obtaining the product portion 3 and the scrap severing so as to make the non-product portion 4 into the plurality of scrap pieces 8.

The trimming line 5 and the scrap severing line 7 show a position where the trimming is to be effected and a position where the scrap severing is to be effected. As for the scrap severing line 7, a plurality of scrap severing lines 7 are provided for severing the non-product portion 4 into a plurality of scrap pieces 8, but a description will be given hereafter of the scrap severing at one scrap severing line 7.

The trimming means 6 includes one trimming press die means 22. having a cutting blade 21 extending along the trimming line 5 as well as another trimming press die means 23 for cutting the plate material 2 along the trimming line 5 in cooperation with the cutting blade 21 of the trimming press die means 22.

The trimming press die means 22 has a trimming press lower die 25 integrally having the cutting blade 21 and a lower die base 26 for fixing and supporting the trimming press lower die 25.

The cutting blade 21 has a fixed blade surface 31 extending in a lateral direction H, a fixed blade surface 32 intersecting the fixed blade surface 31 and extending in a vertical direction V, and a fixed cutting edge 33 which is an intersecting portion between the fixed blade surface 31 and the fixed blade surface 32. The fixed cutting edge 33 extends along the trimming line 5.

The trimming press die means 23 includes a main trimming press die means 41 having a cutting blade 40 extending along a remaining trimming line portion 39 excluding a trimming line portion 38 extending on a side of a cutting blade 37 of one scrap cutting press die 36 in the vicinity of an intersecting portion 35 between the trimming line 5 and the scrap severing line 7, so as to cut the plate material 2 along the remaining trimming line portion 39 in cooperation with the cutting blade 21 of the trimming press die means 22; an auxiliary trimming press die means 43 having a movable cutting blade 42 disposed so as to extend along the trimming line 38 extending on the side of the cutting blade 37 of the scrap cutting press die 36 and to be movable in the vertical direction V relative to the cutting blade 40 of the main trimming press die means 41, so as to cut the plate material 2 in cooperation with the cutting blade 21 of the trimming press die means 22 along the trimming line portion 38 extending on the side of that cutting blade 37 in the vicinity of the intersecting portion 35 between the trimming line 5 and the scrap severing line 7; and an upper die base 44 for holding the main trimming press die means 41 and the auxiliary trimming press die means 43.

Figure 9:
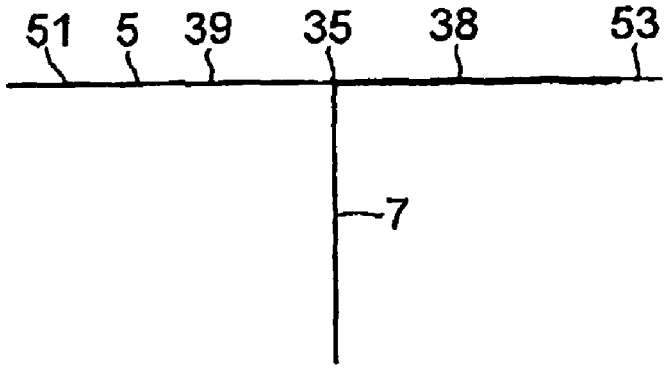
FIG. 9 is an explanatory diagram of a trimming line and a scrap severing line with respect to the plate material which is cut in the embodiment shown in FIG. 1.

As described above, the trimming line 5 includes the trimming line portion 38 indicated by the thick line in FIG. 9 and the trimming line portion 39 other than the trimming line portion 38.

The cutting blade 40 includes a cutting blade 52 extending along one trimming line portion 51 of the trimming line portion 39 severed at the trimming line portion 38, as well as a cutting blade 54 extending along another trimming line portion 53 of the trimming line portion 39 severed at the trimming line portion 38.

The main trimming press die means 41 includes one trimming press upper die 55 integrally having the cutting blade 52 and another trimming press upper die 56 integrally having the cutting blade 54. The trimming press upper dies 55 and 56 are fixed and supported on the upper die base 44 which is connected to a hydraulic ram and is movable in the vertical direction V.

The cutting blade 52 has a blade surface 61 extending in the lateral direction H, a blade surface 62 intersecting the blade surface 61 and extending in the vertical direction V, and a cutting edge 63 which is an intersecting portion between the blade surface 61 and the blade surface 62. The cutting edge 63 extends along the trimming line portion 51. The cutting blade 54 has a blade surface 65 extending in the lateral direction H, a blade surface 66 intersecting the blade surface 65 and extending in the vertical direction V, and a cutting edge 67 which is an intersecting portion between the blade surface 65 and the blade surface 66. The cutting edge 67 extends along the trimming line portion 53.

The movable cutting blade 42, which is sandwiched by the trimming press upper dies 55 and 56 in contact with the trimming press upper dies 55 and 56 and is disposed movably in the vertical direction V, has a movable blade surface 71 extending in the lateral direction H, a movable blade surface 72 intersecting the movable blade surface 71 and extending in the vertical direction V, and a movable cutting edge 73 Which is an intersecting portion between the movable blade surface 71 and the movable blade surface 72. The movable cutting edge 73 extends along the trimming line portion 38. The movement of the movable cutting blade 42 in the vertical direction V is adapted to be guided by the trimming press upper dies 55 and 56.

The blade surfaces 61 and 65 with the movable blade surface 71 sandwiched therebetween are disposed so as to be flush and continuous with the movable blade surface 71 at boundary portions 74 and 75 with the movable blade surface 71 so that a step and a gap will not be produced at the boundary portions 74 and 75 when the movable blade surface 71 does not press the cutting blade 37. Consequently, the cutting blade 40 constituted by the cutting blades 52 and 54 as well as the movable cutting blade 71 are adapted to simultaneously cut the plate material 2 along the trimming line 5 in cooperation with the cutting blade 21 by simultaneously coming into contact with the plate material 2. The blade surfaces 62 and 66 with the movable blade surface 72 sandwiched therebetween are disposed so as to be flush and continuous with the movable blade surface 72 at the boundary portions 74 and 75 with the movable blade surface 72 so that a step and a gap will not be produced at the boundary portions 74 and 75.

The auxiliary trimming press die means 43 has, in addition to the movable cutting blade 42, a liquid pressure generating means 81 for supporting the movable cutting blade 42 and imparting to the movable cutting blade 42 a cutting force based on compressible liquid pressure.

The liquid pressure generating means 81 includes a cylinder 82 which is fixed and supported on the upper die base 44 in the same way as the trimming press upper dies 55 and 56, a piston 83 disposed in the cylinder 82 movably in the vertical direction V, a piston rod 84 having one end coupled to the piston 83 and the other end with the movable cutting blade 42 disposed thereon by being detachably coupled thereto and supported thereby, and a compressible liquid 85 disposed in the cylinder 82.

The compressible liquid 85 generates a large reaction force with respect to a raising force applied to the movable cutting blade 42, but is resiliently compressible. Therefore, the liquid pressure generating means 81 is adapted such that when a large raising force is applied to the movable cutting blade 42, and this large raising force is applied to the piston 83 through the piston rod 84, the compressible liquid 85 is compressed to allow the raising of the movable cutting blade 42, whereas when the large raising force with respect to the movable cutting blade 42 is released, the movable cutting blade 42 is conversely returned to its original position by the expansive force of the compressible liquid 85.

The scrap cutting means 9 includes the scrap cutting press die 36 which has the cutting blade 37 extending along the scrap severing line 7 and is fixed to the lower die base 26 in the same way as the trimming press lower die 25, as well as another scrap cutting press die 92 which has a cutting blade 91 extending along the scrap severing line 7 and is integrally formed with the trimming press upper die 55, so as to cut the non-product portion 4 along the scrap severing line 7 by shearing in cooperation with the cutting blade 37 of the scrap cutting press die 36.

The cutting blade 37 has a fixed blade surface 93 opposing the movable blade surface 71 and extending in the lateral direction H, a fixed blade surface 94 intersecting the fixed blade surface 93 and extending in the vertical direction V, and a fixed cutting edge 95 which is an intersecting portion between the fixed blade surface 93 and the fixed blade surface 94. The fixed blade surface 93 is disposed forwardly in the pressing direction, i.e., lower than the fixed blade surface 31, with a larger step than the thickness of the plate material 2 with respect to the fixed blade surface 31, e.g., with a step which is about three times as large as the thickness of the plate material 2. Consequently, the scrap cutting press die 36 is adapted to cut the non-product portion 4 along the scrap severing line 7 in cooperation with the scrap cutting press die 92 after the cutting of the plate material 2 along the trimming line 5 by the cutting blade 40 of the main trimming press die means 41 and the movable cutting blade 42 of the auxiliary trimming press die means 43 in cooperation with the cutting blade 21 of the trimming press die means 22.

The movable cutting blade 42 is formed such that the width D1 of its movable blade surface 71 opposing the fixed blade surface 93 of the cutting blade 37 is greater than the width D2 of the fixed blade surface 93. From the perspective of suitably sandwiching the non-product portion 4 with the fixed blade surface 93 and the movable blade surface 71 in the shearing of the non-product portion 4 along the scrap severing line 7, the movable cutting blade 42 is preferably formed such that the length L of its movable blade surface 71 is not less than the scrap severing line 7.

The cutting blade 91 has a blade surface 96 continuous with the blade surface 61 and extending in the lateral direction H, a blade surface 97 intersecting the blade surface 96 and extending in the vertical direction V, and a cutting edge 98 which is an intersecting portion between the blade surface 96 and the blade surface 97.

The pad 10 having a lower surface 101 which is disposed flush with or lower than the movable blade surface 71 is connected to the hydraulic ram through an unillustrated resilient member In the same way as the upper die base 44, and is adapted to resiliently clamp by the lower surface 101 the portion of the plate material 2 for serving as the product portion 3 and to fix that portion when the pad 10 is lowered by the actuation of the hydraulic ram.

Figure 10:
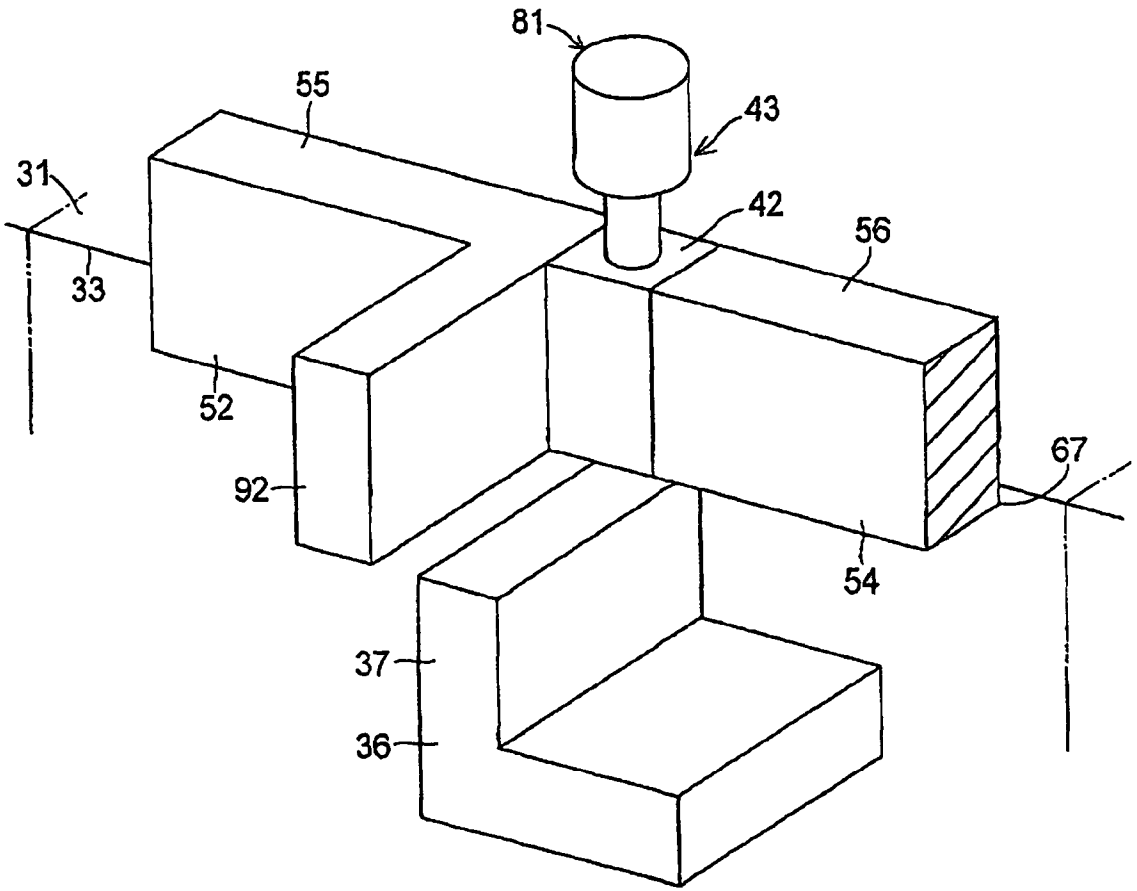
FIG. 10 is a diagram explaining the operation of the embodiment shown in FIG. 1.

In the above-described trimming press working apparatus 1, in a state in which the trimming press upper dies 55 and 56, the auxiliary trimming press die means 43, the scrap cutting press die 92, and the pad 10 are disposed in a raised initial position, as shown in FIGS. 1 to 4, when the plate material 2 subjected to draw forming in the pre-working process is carried in between, on the one hand, these trimming press upper dies 55 and 56, auxiliary trimming press die means 43, scrap cutting press die 92, and pad 10 and, on the other hand, the trimming press lower die 25 and the scrap cutting press die 36, the trimming press upper dies 55 and 56, the auxiliary trimming press die means 43, the scrap cutting press die 92, and the pad 10 are lowered by the actuation of the hydraulic ram connected to the upper die base 44, as shown in FIG. 10.

In the lowering of the trimming press upper dies 55 and 56, the auxiliary trimming press die means 43, the scrap cutting press die 92, and the pad 10, the portion of the plate material 2 for serving as the product portion 3 is resiliently fixed by the clamping of the portion for serving as the product portion 3 in the plate material 2 by the cooperation between the lower surface 101 of the pad 10 and the fixed blade surface 31. Concurrently, the plate material 2 is cut by shearing along the trimming line portion 51 by the fixed cutting edge 33 and the cutting edge 63, along the trimming line portion 38 by the fixed cutting edge 33 and the movable cutting edge 73, and along the trimming line portion 53, by the fixed cutting edge 33 and the cutting edge 67. Thus, the non-product portion 4 other than the product portion 3 is fast cut by shearing along the trimming line 5 from the portion of the plate material 2 for serving as the product portion 3.

Figure 11:
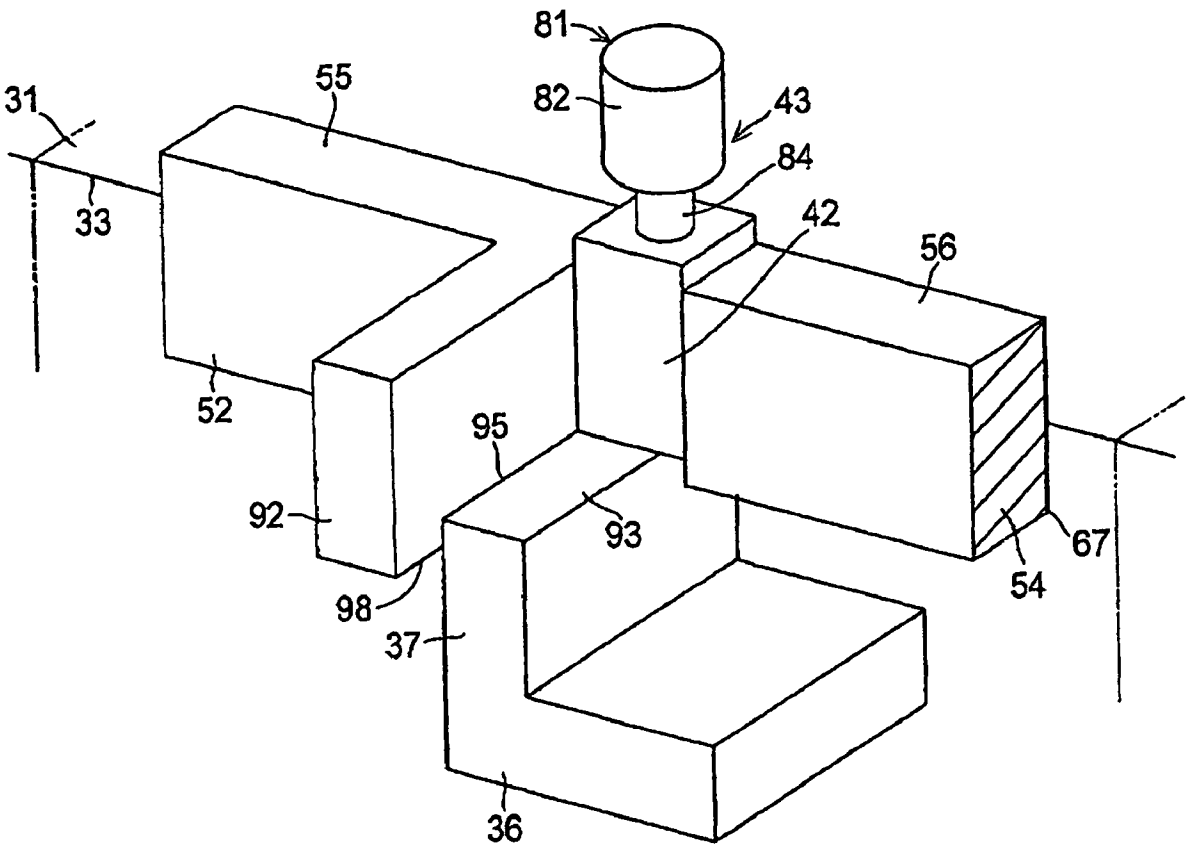
FIG. 11 is a diagram explaining the operation of the embodiment shown in FIG. 1.

In the further lowering of the trimming press upper dies 55 and 56, the auxiliary trimming press die means 43, and the scrap cutting press die 92 by the hydraulic ram, when the movable blade surface 71 of the movable cutting blade 42 of the auxiliary trimming press die means 43 presses the fixed blade surface 93 of the cutting blade 37 with the non-product portion 4 of the plate material 2 located therebetween, a large raising force is applied to the movable cutting blade 42 owing to its reaction force. When this large raising force is applied to the piston 83 through the piston rod 84, the compressible liquid 85 is compressed to allow the relative raising of the movable cutting blade 42 with respect to the trimming press upper dies 55 and 56, and the scrap cutting press die 92. As a result, the lowering of the movable cutting blade 42 is stopped despite the further lowering of the trimming press upper dies 55 and 56, and the scrap cutting press die 92. In such further lowering of the scrap cutting press die 92, the non-product portion 4 of the plate material 2 is cut by shearing along the scrap severing line 7 by the fixed cutting edge 95 and the cutting edge 98, as shown in FIG. 11, thereby severing the non-product portion 4 into the scrap pieces 8 at the scrap severing line 7.

After the severing of the non-product portion 4 into the scrap pieces 8, the raising of the trimming press upper dies 55 and 56, the auxiliary trimming press die means 43, the scrap cutting press die 92, and the pad 10 by the hydraulic ram is carried out, and these members are returned to their original positions.

As described above, in the trimming press working apparatus 1, the cutting force attributable to the lowering force of the hydraulic ram is imparted to the movable cutting blade 42 through the liquid pressure generating means 82, and the cutting along the trimming line portions 51 and 53 by the cutting blades 52 and 54 and the cutting along the trimming line portion 38 by the movable cutting blade 42 are effected simultaneously. Therefore, it is possible to eliminate the occurrence of chips and the like in the cutting in the vicinity of the intersecting portion 35, and it is possible to use shearing without requiring a large amount of bite and without relying on tension shear or tear rupture. Thus, burrs are not produced on the product portion 3, and it is possible to reliably effect the severing between the product portion 3 and the non-product portion 4 and the severing of the non-product portion 4 into the scrap pieces 8.

The invention claimed is:

1. A trimming press working apparatus comprising:

trimming means for cutting a plate material along a trimming line which divides a product portion from a non-product portion in the plate material; and scrap cutting means for cutting the non-product portion along a scrap severing line intersecting the trimming line, said trimming means including one trimming press die means having a first cutting blade extending along the trimming line and another trimming press die means for cutting the plate material along the trimming line in cooperation with the first cutting blade of said one trimming press die means, said scrap cutting means including one scrap cutting press die having a second cutting blade extending along the scrap severing line and another scrap cutting press die having a third cutting blade extending along the scrap severing line so as to cut the non-product portion along the scrap severing line in cooperation with the second cutting blade of said one scrap cutting press die, said trimming line including first and second trimming line portions and a third trimming line portion disposed between said first and second trimming line portions and having a one end intersected with a one end of the scrap severing line, said another trimming press die means including main trimming press die means having a fourth cutting blade extending along the first and second trimming line portions so as to cut the plate material along the first and second trimming line portions in cooperation with the first cutting blade of said one trimming press die means, and auxiliary trimming press die means having a movable cutting blade extending along the third trimming line portion to be movable relative to the fourth cutting blade of said main trimming press die means so as to cut the plate material in cooperation with the first cutting blade of said one trimming press die means along the third trimming line portion, said auxiliary trimming press die means having liquid pressure generating means for imparting to the movable cutting blade a cutting force based on compressible liquid pressure.

2. The trimming press working apparatus according to claim 1, wherein said liquid pressure generating means is adapted to impart to the movable cutting blade the cutting force based on the compressible liquid pressure derived from a liquid in which a porous substance having a multiplicity of pores is present in mixed form or a liquid constituted by flowable organopolysiloxane.

3. The trimming press working apparatus according to claim 1, wherein the fourth cutting blade of said main trimming press die means and the movable cutting blade of said auxiliary trimming press die means are adapted to simultaneously cut the plate material along the trimming line in cooperation with the first cutting blade of said one trimming press die means by simultaneously coming into contact with the platematerial.

4. The trimming press working apparatus according to claim 1, wherein said another scrap cutting press die is adapted to cut the non-product portion along the scrap severing line in cooperation with said one scrap cutting press die after the cutting of the plate material along the trimming line by the fourth cutting blade of said main trimming press die means and the movable cutting blade of said auxiliary trimming press die means in cooperation with the first cutting blade of said one trimming press die means.

5. The trimming press working apparatus according to claim 1, wherein one blade surface of the second cutting blade of said one scrap cutting press die is disposed forwardly in a pressing direction with a larger step than a thickness of the plate material with respect to a blade surface of the first cutting blade of said one trimming press die means.

6. The trimming press working apparatus according to claim 1, wherein said liquid pressure generating means includes a cylinder, a piston disposed in the cylinder, a piston rod having one end coupled to the piston and another end with the movable cutting blade disposed thereon, and a compressible liquid disposed in the cylinder.

* * * * *